US007066270B2

(12) United States Patent
Murray

(10) Patent No.: US 7,066,270 B2
(45) Date of Patent: Jun. 27, 2006

(54) MULTILATERAL REFERENCE POINT SLEEVE AND METHOD OF ORIENTING A TOOL

(75) Inventor: Douglas J. Murray, Humble, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/898,795

(22) Filed: Jul. 3, 2001

(65) Prior Publication Data

US 2002/0011340 A1 Jan. 31, 2002

Related U.S. Application Data

(60) Provisional application No. 60/216,807, filed on Jul. 7, 2000.

(51) Int. Cl.
*E21B 7/06* (2006.01)
*E21B 23/12* (2006.01)

(52) U.S. Cl. ..... 166/380; 166/382; 166/117.5

(58) Field of Classification Search ..... 166/380, 166/117.5, 117.6, 50, 381, 255.2, 255.3, 240, 166/241.6, 241.7, 206
See application file for complete search history.

(56) References Cited

U.S. PATENT DOCUMENTS

| | | | | |
|---|---|---|---|---|
| 3,199,613 | A * | 8/1965 | Malott et al. | 175/5 |
| 3,712,376 | A * | 1/1973 | Owen et al. | 166/277 |
| 4,033,409 | A | 7/1977 | Hebert | 166/117.5 |
| 5,311,936 | A * | 5/1994 | McNair et al. | 166/50 |
| 5,335,737 | A * | 8/1994 | Baugh | 166/117.6 |
| 5,467,819 | A * | 11/1995 | Braddick | 166/117.6 |
| 5,613,559 | A * | 3/1997 | Williamson et al. | 166/381 |
| 5,730,224 | A * | 3/1998 | Williamson et al. | 166/117.6 |
| 6,000,300 | A * | 12/1999 | Plamondon | 81/90.2 |
| 6,012,527 | A * | 1/2000 | Nitis et al. | 166/313 |
| 6,070,671 | A * | 6/2000 | Cumming et al. | 166/381 |
| 6,089,319 | A * | 7/2000 | Singleton | 166/117.5 |
| 6,173,796 | B1 * | 1/2001 | McLeod | 175/257 |
| 6,209,644 | B1 * | 4/2001 | Brunet | 166/117.6 |
| 6,315,044 | B1 * | 11/2001 | Tinker | 166/298 |
| 6,390,198 | B1 * | 5/2002 | Brooks et al. | 166/313 |
| 6,446,323 | B1 * | 9/2002 | Metcalfe et al. | 29/523 |
| 6,488,095 | B1 * | 12/2002 | Buytaert | 166/382 |
| 6,499,537 | B1 | 12/2002 | Dewey et al. | 166/255.1 |
| 6,543,536 | B1 * | 4/2003 | Dewey et al. | 166/255.2 |
| 6,591,905 | B1 * | 7/2003 | Coon | 166/117.6 |

FOREIGN PATENT DOCUMENTS

| | | | |
|---|---|---|---|
| GB | 1149808 | A | 9/1967 |
| GB | 2332462 | A | 6/1999 |
| GB | 2349903 | A | 11/2000 |
| WO | WO 94/29563 | A1 | 12/1994 |
| WO | WO 99/49178 | A1 | 9/1999 |
| WO | WO 01/88336 | A1 | 11/2001 |

* cited by examiner

*Primary Examiner*—Kenneth Thompson
(74) *Attorney, Agent, or Firm*—Cantor Colburn LLP

(57) ABSTRACT

A multilateral reference point sleeve includes a tubular member configured to be received in a tubing string of a wellbore. The tubular member has an uphole end and a downhole end. The uphole end is angled to define an orientation profile, and the orientation profile has an orientation slot extending therefrom. A method for orienting a tool in a wellbore includes running the multilateral reference point sleeve into the casing in the wellbore, anchoring the sleeve to an inner surface of the casing, running the tool into the tubing string, causing a pin on the tool to engage the orientation profile on the sleeve, and causing the pin on the tool to engage the orientation slot on the orientation profile.

15 Claims, 3 Drawing Sheets

MULTILATERAL REFERENCE POINT SLEEVE AND METHOD OF ORIENTING A TOOL

CROSS REFERENCE TO RELATED APPLICATIONS

This application claims the benefit of an earlier filing date from U.S. Ser. No. 60/216,807, filed Jul. 7, 2000, the entire contents of which is incorporated herein by reference.

BACKGROUND

In existing oil and gas wells where a multilateral junction is employed to effect lateral drilling into oil and gas formations not accessed by the primary wellbore, re-entry can be a difficult proposition. Several tools currently exist for locating a window for re-entry but each has disadvantages in either operation or cost.

SUMMARY

A multilateral reference point sleeve and a method for orienting a tool in a wellbore to facilitate the installation of a multilateral junction or re-entry to a lateral borehole are disclosed. An advantage to the disclosed device and method is that the sleeve of the device has a relatively thin wall thickness, which allows for a minimum amount of reduction in cross sectional area of the wellbore in the vicinity of the installed device. The device comprises a sleeve configured to be received in a casing of a wellbore. The sleeve has an uphole end and a downhole end. The uphole end includes an edge that defines an orientation profile.

At the downhole most section of the orientation profile, an orientation slot extends therefrom in a downhole direction. The orientation slot is configured to receive a pin on a tool run in the hole to engage the device causing the tool to orient to a particular direction as calculated by the placement of the pin at the surface.

The sleeve is anchorable within the casing through the radial expansion of the downhole end of the sleeve against an inner surface of the casing. In one embodiment, the wall thickness of the sleeve proximate the downhole end of thereof is reduced as compared to the thickness of the wall proximate the uphole end of the sleeve resulting in easier expansion of the sleeve by methods such as swaging and inflatables which do not require specific discussion.

The method for orienting a tool in the wellbore includes running the multilateral reference point sleeve in the hole, anchoring the sleeve to the inner surface of the casing, and running a tool into the sleeve. Once the tool engages the sleeve, a pin on the tool engages the orientation profile and causes the rotation of the tool. Rotation stops when the pin drops into the slot. When properly oriented, the pin drops into the orientation slot, thereby causing the tool to maintain its proper orientation, which allows for control over direction for lateral drilling.

DETAILED DESCRIPTION

The multilateral reference point sleeve is a tubular member that is positionable within the casing of a wellbore to define a reference point for the installation of a multilateral junction or to facilitate re-entry to a lateral borehole at a later operation. The sleeve has an orientation profile along an uphole edge and an orientation slot cut or formed therein to lock a tool into its proper orientation, thereby ensuring proper rotational alignment of the tool with respect to the wellbore.

Figure 1:
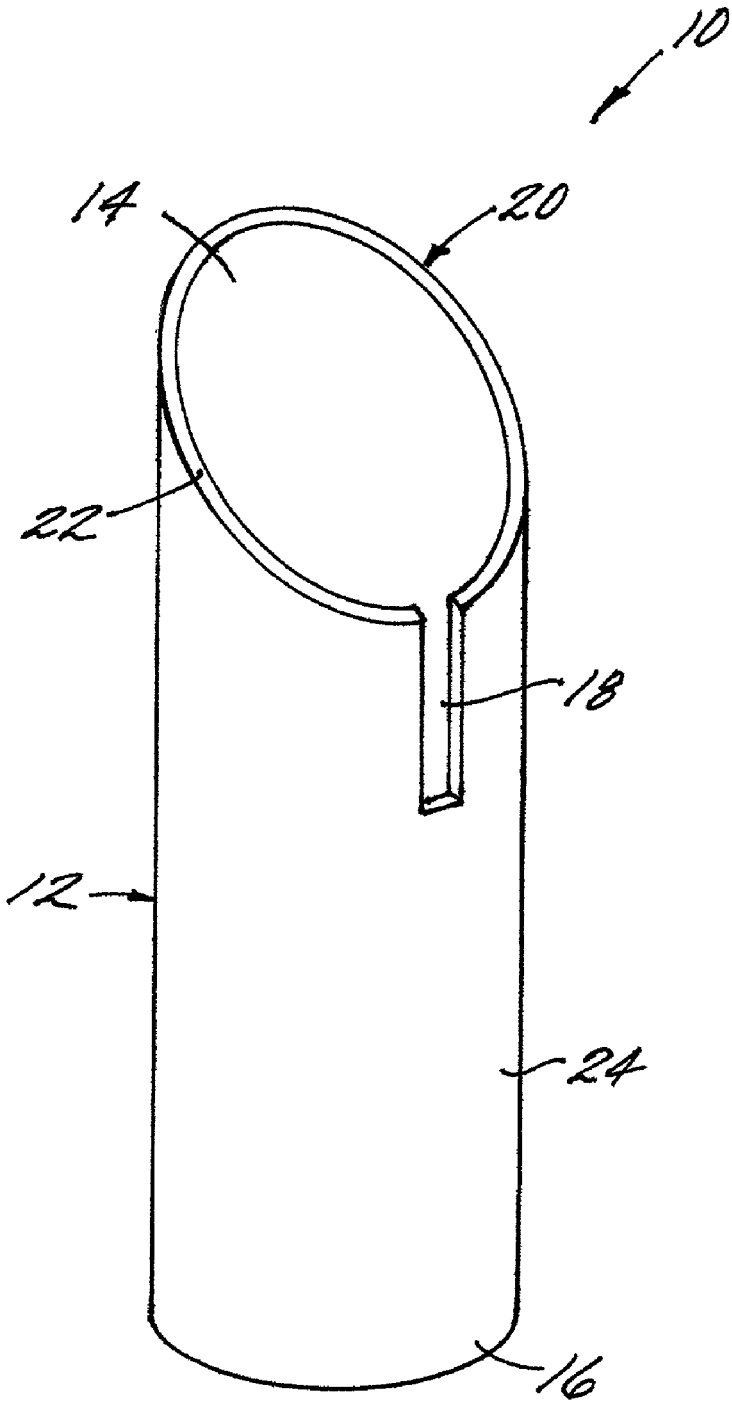
FIG. 1 is a perspective view of a multilateral reference point device.

Referring to FIG. 1, a multilateral reference point sleeve is shown generally at 10 and is hereinafter referred to as "sleeve 10". Sleeve 10 comprises a tubular member 12 having an uphole end 14 and a downhole end 16. Uphole end 14 is configured to have an orientation slot 18 cut or formed therein extending from an orientation profile, shown generally at 20, which is defined by an upper edge 22 of tubular member 12.

Figure 3:
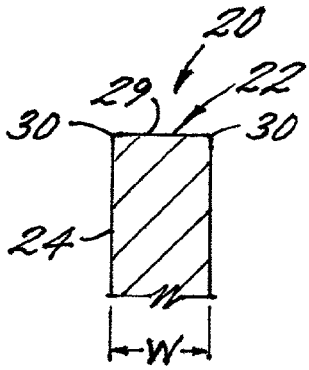
FIG. 3 is a side sectional view of an orientation profile of the multilateral reference point device.

Tubular member 12 is of a cross sectional shape that substantially conforms to the cross sectional shape of the casing of a wellbore (shown below with reference to FIGS. 3 and 4). In one embodiment the cross sectional shape is circular, although an elliptical or other shape may be used to define the cross section of the wellbore. A wall 24 of tubular member 12 is of a thickness that allows for a minimum amount of reduction in cross sectional area of the casing into which sleeve 10 is inserted while still enabling a tool to be properly oriented within the casing.

Figure 2:
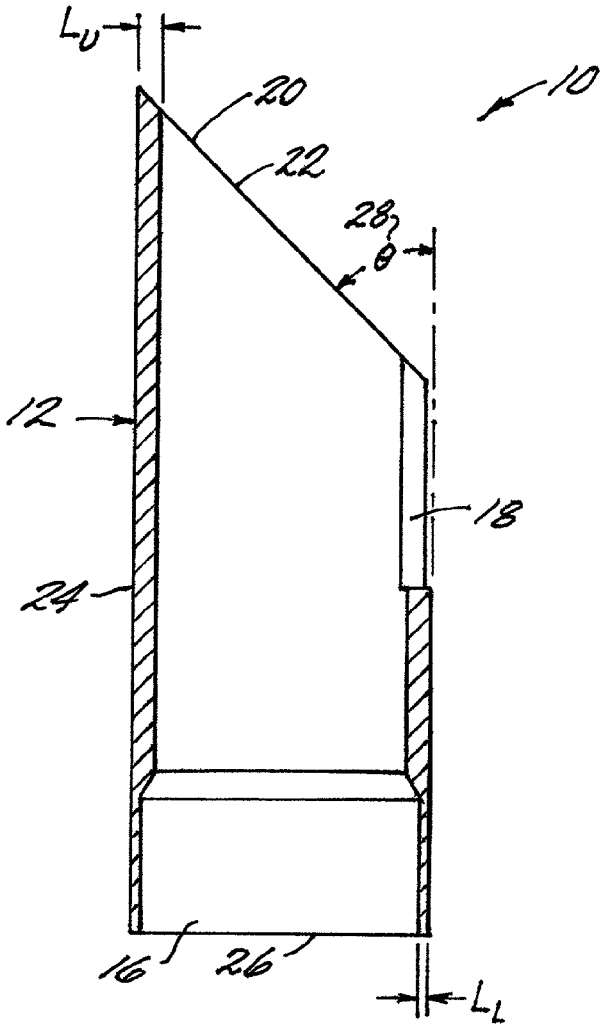
FIG. 2 is a side sectional view of the multilateral reference point device.

Referring now to FIG. 2, downhole end 16 of tubular member 12 terminates in a lower edge 26. Wall 24 proximate lower edge 26 is configured to facilitate the anchoring of sleeve 10 into place within the casing. The anchoring of sleeve 10 is facilitated by the radial expansion of lower edge 26 of tubular member 12. In one embodiment, wall 24 proximate lower edge 26 has a thickness $L_L$ that is significantly less than a thickness $L_U$ of wall 24 proximate upper edge 22. The reduced thickness of the downhole end of the tubular member facilitates easier expansion thereof for retention within the wellbore.

Uphole end 14 of tubular member 12 is configured to form an angle 28 relative to the surface of wall 24. Therefore, the overall length of sleeve 10 from uphole end 14 to downhole end 16 is variable and has a value dependent upon the point on wall 24 at which the length is measured. Angle 28 defines orientation profile 20 of sleeve 10 having thickness $L_U$. Angle 28 may be of any common orientation profile angle known to the art. Referring to FIG. 3, orientation profile 20 of the sleeve comprises a surface 29 that is perpendicularly situated with respect to wall 24. In a preferred embodiment, a width W of surface 29 of orientation profile 20 is maximized by minimizing the radius of edges 30 at which surface 29 and wall 24 meet.

Referring back to FIGS. 1 and 2, orientation slot 18 is formed or cut into sleeve 10 at a point that coincides with the most downhole point of orientation profile 20. Upon installation of the sleeve, care is taken to orient the slot in the desired direction. Orientation slot 18 extends perpendicularly from orientation profile 20 along the length of tubular member 12 for a distance D. Orientation slot 18 is dimensioned and configured to receive a pin (not shown) on a tool being run to engage the device and orientate the tool.

It should be appreciated that the reference point disclosed may be installed before or after the creation of a multilateral junction. Where such is installed before the junction, it may be used to assist in locating tools to create the junction. In the event it is installed after the completion of the junction it is useful in assisting re-entry operations.

Figure 4:
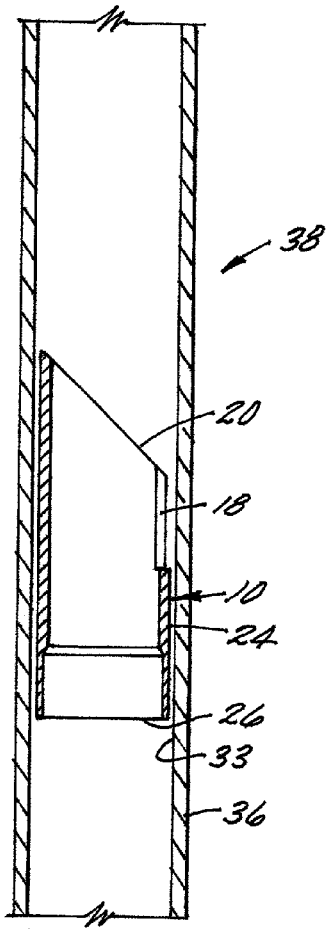
FIG. 4 is a side sectional view of the multilateral reference point device positioned within a tubing string in a wellbore prior to the device being expanded to be anchored in place.

Referring now to FIG. 4, the method of using sleeve 10 to orient the tool in a casing 36 of a wellbore, shown generally at 38, is illustrated. The method entails running sleeve 10 with orientation profile 20 in the uphole position into the existing casing 36. In running sleeve 10 into casing 36, care should be taken to ensure that sleeve 10 is properly positioned at the desired reference point.

Figure 5:
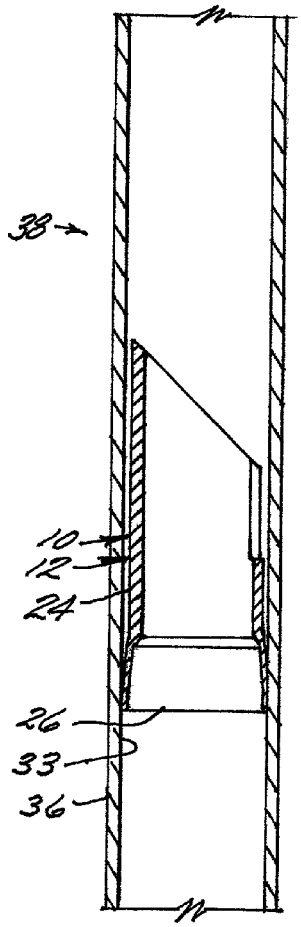
FIG. 5 is a side sectional view of the multilateral reference point device positioned within the casing in the wellbore and expanded to be anchored in place.

Referring to FIG. 5, sleeve 10 is shown anchored into position. When sleeve 10 is in its proper position within casing 36, lower edge 26 is expanded radially against an inner surface 33 of casing 36, thereby securing sleeve 10 into place within casing 36. Because of the reduced thickness of wall 24 proximate lower edge 26 of tubular member 12, a minimum amount of effort is required to expand lower edge 26 to anchor sleeve 10. In one application, lower edge 26 is expanded using an inflatable or mechanically expandable packer (not shown).

As a pin located on the tool engages orientation profile 20, the pin follows along orientation profile 20 until it reaches the most downhole point of orientation profile 20 where it moves into orientation slot 18. As the pin follows orientation profile 20, the tool to which the pin is connected rotates and is oriented within sleeve 10 and is properly situated for the desired operation. The exact rotational position of sleeve 10 can be determined using standard tools and methods either before installing sleeve 10 at the proper depth in casing 36 or thereafter.

If desired in some applications, a collet groove (not shown) may be added to tubular member 12 for use in securing tools to the sleeve. A collet mechanism on the tool can be used to secure the tool in the sleeve 10.

From this position, sleeve 10 can also provide a depth register. Sleeve 10 is intended to be positioned below the point at which the installation of the multilateral junction is desired or has been created. By the engagement of the tool with orientation profile 20, an operator at the surface can direct the drilling of a lateral wellbore into a gas and oil formation or re-entry thereto with great precision.

While preferred embodiments have been shown and described, various modifications and substitutions may be made thereto without departing from the spirit and scope of the invention. Accordingly, it is to be understood that the present invention has been described by way of illustration and not limitation.

The invention claimed is:

1. A multilateral orientation device comprising:

a non-diverter tubular sleeve composed of a single piece of material at least a portion of which is circumferentially closed, said sleeve having a wall thickness selected to minimize restriction of a borehole in which the sleeve is installable, said thickness being insufficient to divert a tool and sufficient to orient a tool;

an expandable section of the sleeve, said section being radially expandable to assume a larger circumferential dimension such that an interference fit with a wellbore in which the device is to be deployed is achievable; and an rotational orientation profile disposed at an axial end of said sleeve.

2. A multilateral orientation device as claimed in claim 1 wherein said orientation profile has an orientation opening therein.

3. A multilateral orientation device as claimed in claim 1 wherein a surface of said orientation profile is positioned proximate the wellbore casing.

4. A method for orienting a tool in a wellbore, comprising:

running a multilateral orientation device sleeve as defined in claim 1 into a tubing string in said wellbore;

anchoring said multilateral reference point sleeve to an inner surface of said casing;

running said tool into said casing;

causing a pin on said tool to engage an orientation profile on said multilateral reference point sleeve.

5. A multilateral orientation device as claimed in claim 2 wherein said opening is a slot.

6. A multilateral orientation device as claimed in claim 2 wherein said orientation opening extends along a wall of said tubular member from said orientation profile and is configured to receive a pin on a separate tool and to orient said separate tool.

7. A method for orienting a tool in wellbore as claimed in claim 4 wherein said opening is an orientation slot.

8. A method for orienting a tool in a wellbore, comprising:

running a multilateral orientation device comprising a circumferentially closed single piece sleeve, said sleeve having a material thickness insufficient to divert another tool and sufficient to orient a tool, the sleeve further including at least a portion thereof configured to expand radially into interference contact with said wellbore;

expanding said multilateral orientation device to achieve an interference fit with an inner surface of said wellbore to permanently anchor said multilateral orientation device in said wellbore;

running said tool into said wellbore;

causing a pin on said tool to engage an orientation profile on said multilateral orientation device sleeve such that said tool is oriented by an interaction between said pin and said orientation profile.

9. A method for orienting a tool in wellbore as claimed in claim 8 further including causing said pin on said tool to engage an orientation opening on said orientation profile.

10. A method for orienting a tool in wellbore as claimed in claim 8 wherein said opening is a slot.

11. The method of claim 8 wherein said causing of said pin on said tool to engage said orientation profile rotates said tool into a desired orientation.

12. The method of claim 11 wherein said causing of said pin on said tool to engage said orientation slot causes said tool to be retained in position.

13. The method of claim 11 wherein said causing of said pin on said tool to engage said orientation slot causes said tool to be retained in an orientated position.

14. A multilateral orientation device comprising:

a non-diverter tubular sleeve composed of a single piece of material at least a portion of which is circumferentially closed, said sleeve having a wall thickness selected to minimize restriction of a borehole in which the sleeve is installable, said thickness being insufficient to divert a tool and sufficient to orient a tool;

an expandable section of the sleeve, said section being radially expandable to assume a larger circumferential dimension such that an interference fit with a welibore in which the device is to be deployed is achievable, said section of the sleeve being at a downhole end of the sleeve and having a lesser thickness than an uphole end of the sleeve; and an orientation profile disposed at an axial end of said sleeve.

15. A multilateral reference point sleeve, comprising:

a tubular member at least a portion of which is circumferentially closed, said member having a wall thickness selected to minimize restriction of a borehole in which said sleeve is installable, said member installable subsequent to installation of a casing in a wellbore to be received in direct contact with the casing of the wellbore, said tubular member having an uphole end and a downhole end, said uphole end defining an orientation profile configured to cause a pin on a separate tool to ride along said orientation profile causing said separate tool to orientate.

* * * * *